US010330408B2

(12) United States Patent
Rode et al.

(10) Patent No.: US 10,330,408 B2
(45) Date of Patent: Jun. 25, 2019

(54) PISTON FOR A GAS-OPERATED FIREARM

(71) Applicant: KNS Precision, Inc., Fredericksburg, TX (US)

(72) Inventors: Nicholas Adam Rode, Hunt, TX (US); Daniel Earl Fisher, Fredericksburg, TX (US); Christian Kager Welch, Fredericksburg, TX (US)

(73) Assignee: KNS PRECISION, INC., Fredericksburg, TX (US)

( * ) Notice: Subject to any disclaimer, the term of this patent is extended or adjusted under 35 U.S.C. 154(b) by 0 days.

(21) Appl. No.: 15/795,298

(22) Filed: Oct. 27, 2017

(65) Prior Publication Data

US 2018/0156553 A1 Jun. 7, 2018

Related U.S. Application Data

(60) Provisional application No. 62/428,643, filed on Dec. 1, 2016, provisional application No. 62/525,546, filed on Jun. 27, 2017.

(51) Int. Cl.
*F41A 5/20* (2006.01)
*F41A 5/28* (2006.01)

(52) U.S. Cl.
CPC . *F41A 5/20* (2013.01); *F41A 5/28* (2013.01)

(58) Field of Classification Search
CPC ..... F41A 5/18; F41A 5/20; F41A 5/22; F41A 5/26; F41A 5/28
USPC ..... 89/191.01, 191.02, 192, 193
See application file for complete search history.

(56) References Cited

U.S. PATENT DOCUMENTS 1,227,897 A * 5/1917 Dunwoody ..... F41A 13/12 16/431
2,800,059 A * 7/1957 Miller ..... F41A 5/26 89/193
3,198,076 A * 8/1965 Stoner ..... F41A 3/26 42/75.02

(Continued)

OTHER PUBLICATIONS

National Ground Intelligence Center, "(U) M76 Semiautomatic 7.9mm Sniper's Gun With Optical Sight (Workshop Maintenance and Repair)," Jan. 4, 2005.

(Continued)

*Primary Examiner* — Joshua E Freeman
(74) *Attorney, Agent, or Firm* — Bennet K. Langlotz; Langlotz Patent & Trademark Works, LLC

(57) ABSTRACT

A piston for a gas-operated firearm has an elongated body having a head portion adapted to be closely received in the cylindrical bore for reciprocation within the bore, the head portion having a first side toward a forward direction and a second side toward the rearward direction, the body having an operational facility on the second side adapted to transmit an operating force to the action in response to gas pressure on the first side, and the head portion defining a bypass passage between the first side and the second side. The bypass passage may have an adjustment facility adapted to provide selectable resistance to gas flow through the bypass passage. The adjustment facility may be a movable occlusion element that selectably occludes the bypass passage. The occlusion element may be a threaded element. The occlusion element may be a collar that receives a portion of the body.

17 Claims, 9 Drawing Sheets

(56) References Cited

U.S. PATENT DOCUMENTS

| | | | | |
|---|---|---|---|---|
| 3,707,110 | A * | 12/1972 | Alday | F41A 5/28 89/193 |
| 4,244,273 | A * | 1/1981 | Langendorfer, Jr. | F41A 5/28 89/193 |
| 7,469,624 | B1 * | 12/2008 | Adams | F41A 5/26 89/191.01 |
| 7,739,939 | B2 * | 6/2010 | Adams | F41A 5/26 89/191.01 |
| 7,832,326 | B1 * | 11/2010 | Barrett | F41A 5/18 42/95 |
| 8,875,614 | B2 * | 11/2014 | Gomez | F41G 1/02 89/193 |
| 9,170,061 | B2 * | 10/2015 | Gomez | F41G 1/02 |
| 9,423,197 | B2 * | 8/2016 | Gomez | F41G 1/02 |
| 9,816,769 | B1 * | 11/2017 | Brown | F41A 21/28 |
| 10,030,922 | B2 * | 7/2018 | Gomez | F41A 5/28 |
| 2007/0199435 | A1 * | 8/2007 | Hochstrate | F41A 3/66 89/191.02 |
| 2008/0276797 | A1 * | 11/2008 | Leitner-Wise | F41A 3/12 89/191.01 |
| 2009/0223357 | A1 * | 9/2009 | Herring | F41A 5/18 89/192 |
| 2010/0000400 | A1 * | 1/2010 | Brown | F41A 5/18 89/191.01 |
| 2010/0269682 | A1 * | 10/2010 | Vuksanovich | F41A 3/26 89/191.01 |
| 2011/0023699 | A1 * | 2/2011 | Barrett | F41A 5/28 89/193 |
| 2011/0094373 | A1 * | 4/2011 | Cassels | F41A 5/26 89/191.01 |
| 2012/0167757 | A1 * | 7/2012 | Gomez | F41G 1/02 89/193 |
| 2013/0025445 | A1 * | 1/2013 | Windauer | F41A 5/26 89/193 |
| 2014/0060312 | A1 * | 3/2014 | Ruck | F41A 5/28 89/193 |
| 2014/0076143 | A1 * | 3/2014 | Hall | F41A 19/03 89/129.01 |
| 2014/0083286 | A1 * | 3/2014 | Gomez | F41A 5/28 89/193 |
| 2014/0260947 | A1 * | 9/2014 | Gomez | F41G 1/02 89/193 |
| 2015/0176933 | A1 * | 6/2015 | Adams | F41A 5/28 89/191.02 |
| 2015/0292825 | A1 * | 10/2015 | Cassels | F41A 5/28 89/193 |
| 2016/0084597 | A1 * | 3/2016 | Ricks | F41A 5/22 89/193 |
| 2016/0109200 | A1 * | 4/2016 | Gomez | F41G 1/02 89/193 |
| 2016/0178299 | A1 * | 6/2016 | Cassels | F41A 5/28 89/193 |
| 2016/0209138 | A1 * | 7/2016 | DeSomma | F41A 5/28 |
| 2017/0198998 | A1 * | 7/2017 | Gomez | F41G 1/02 |

OTHER PUBLICATIONS

KNS Precision, Inc., "M76 Factory Gas System," Applicant's best understood depiction of M76 as admitted prior art, Feb. 7, 2019.

* cited by examiner

PISTON FOR A GAS-OPERATED FIREARM

CROSS-REFERENCE TO RELATED APPLICATIONS

This application claims the benefit of U.S. Provisional Patent Application No. 62/428,643 filed on Dec. 1, 2016, entitled "PISTON-BASED METHOD OF GAS REGULATION FOR SELF-LOADING FIREARMS," and also claims the benefit of U.S. Provisional Patent Application No. 62/525,546 filed on Jun. 27, 2017, entitled "METHODS FOR VENTING EXCESS GAS THROUGH AND/OR AROUND A PISTON," which are hereby incorporated by reference in its entirety for all that is taught and disclosed therein.

FIELD OF THE INVENTION

The present invention relates to firearms, and more particularly to a piston for a gas-operated firearm that is tunable to control how much energy from the expanding gas is converted into motion to cycle the firearm.

BACKGROUND OF THE INVENTION

Gas-operated firearms utilize a portion of the high-pressure gas resulting from the discharge of a cartridge to cycle the action of the firearm. The portion of high-pressure gas typically exits via a port in the barrel, and subsequently impinges on the surface of a piston head. Resulting movement of the piston unlocks the action, extracts the spent case from the chamber, ejects the spent case from the firearm, cocks the hammer, chambers a fresh cartridge from a magazine, and locks the action.

The high-pressure gas must be regulated to avoid either excessive or inadequate pressure. Excessive pressure generates unwanted wear and potential damage to components, if the energy is well more than that needed to cycle the action. Inadequate pressure may be insufficient to cycle the action, and generate malfunctions. Normally, a firearm is designed for a given application, such as a certain type of ammunition and certain accessories (such as a sound suppressor or lack thereof) within a suitable operating range for that application. However, when users wish to change some aspect of the application, they may face major tasks to modify or replace major components on their rifle to provide a suitable gas flow. Various methods have been used, including tuning the gas port size, adjusting the mass of the operating parts, and changing spring characteristics to prevent overly violent (or inadequate) movement of the action. While these traditional approaches are effective at controlling movement of the action, the use of a sound suppressor or specialized ammunition with a firearm can result in excessive gas pressure that accelerates wear and adversely affects accuracy. While some firearms have gas blocks that can be replaced with alternatives that reduce the gas pressure, some firearms have permanently-mounted gas blocks or gas blocks that are difficult to remove.

Therefore, a need exists for a new and improved piston for a gas-operated firearm that enables the user to easily adjust the gas pressure applied to the action components of the firearm. In this regard, the various embodiments of the present invention substantially fulfill at least some of these needs. In this respect, the piston for a gas-operated firearm according to the present invention substantially departs from the conventional concepts and designs of the prior art, and in doing so provides an apparatus primarily developed for the purpose of enabling the user to easily adjust the gas pressure applied to the action components of the firearm.

SUMMARY OF THE INVENTION

The present invention provides an improved piston for a gas-operated firearm, and overcomes the above-mentioned disadvantages and drawbacks of the prior art. As such, the general purpose of the present invention, which will be described subsequently in greater detail, is to provide an improved piston for a gas-operated firearm that has all the advantages of the prior art mentioned above.

To attain this, the preferred embodiment of the present invention essentially comprises an elongated body having a head portion adapted to be closely received in the cylindrical bore for reciprocation within the bore, the head portion having a first side toward a forward direction and a second side toward the rearward direction, the body having an operational facility on the second side adapted to transmit an operating force to the action in response to gas pressure on the first side, and the head portion defining a bypass passage between the first side and the second side. The bypass passage may have an adjustment facility adapted to provide selectable resistance to gas flow through the bypass passage. The adjustment facility may be a movable occlusion element that selectably occludes the bypass passage. The occlusion element may be a threaded element. The occlusion element may be a collar that receives a portion of the body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
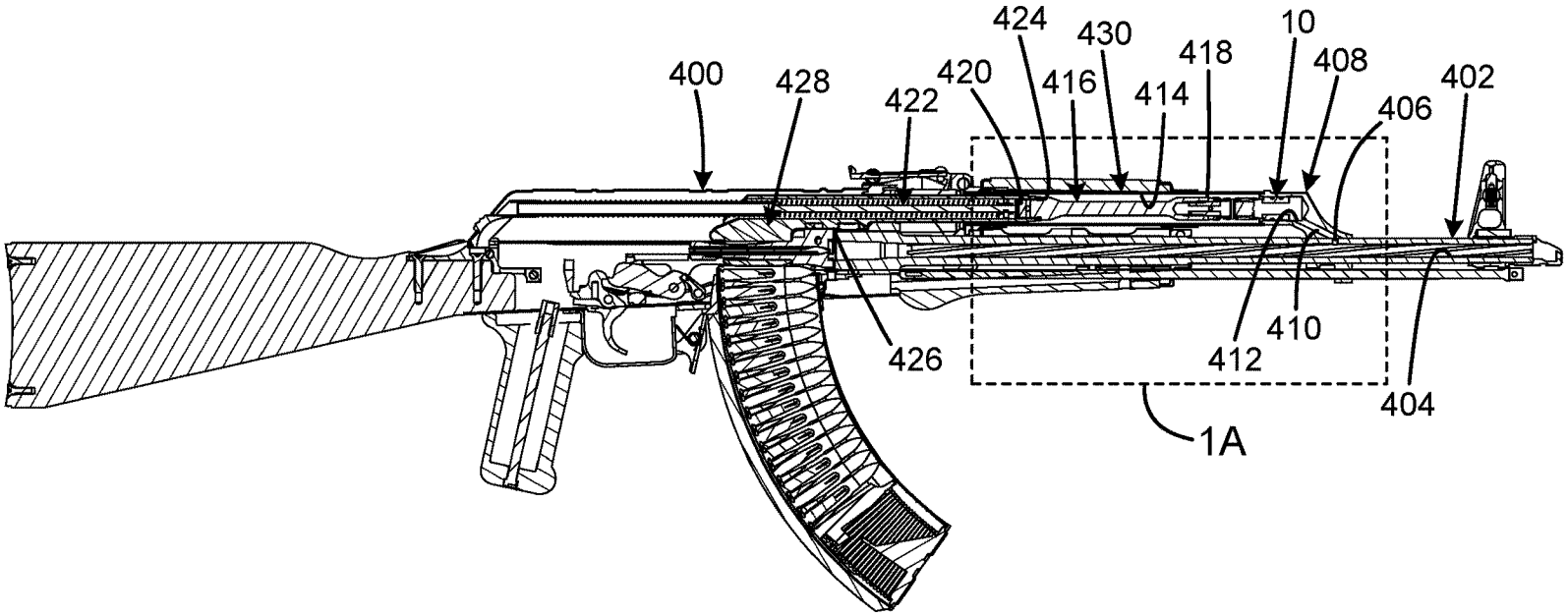
FIG. 1 is a side sectional view of the current embodiment of the piston for a gas-operated firearm constructed in accordance with the principles of the present invention in use installed in a rifle.

An embodiment of the piston for a gas-operated firearm of the present invention is shown and generally designated by the reference numeral 10.

Figure 1A:
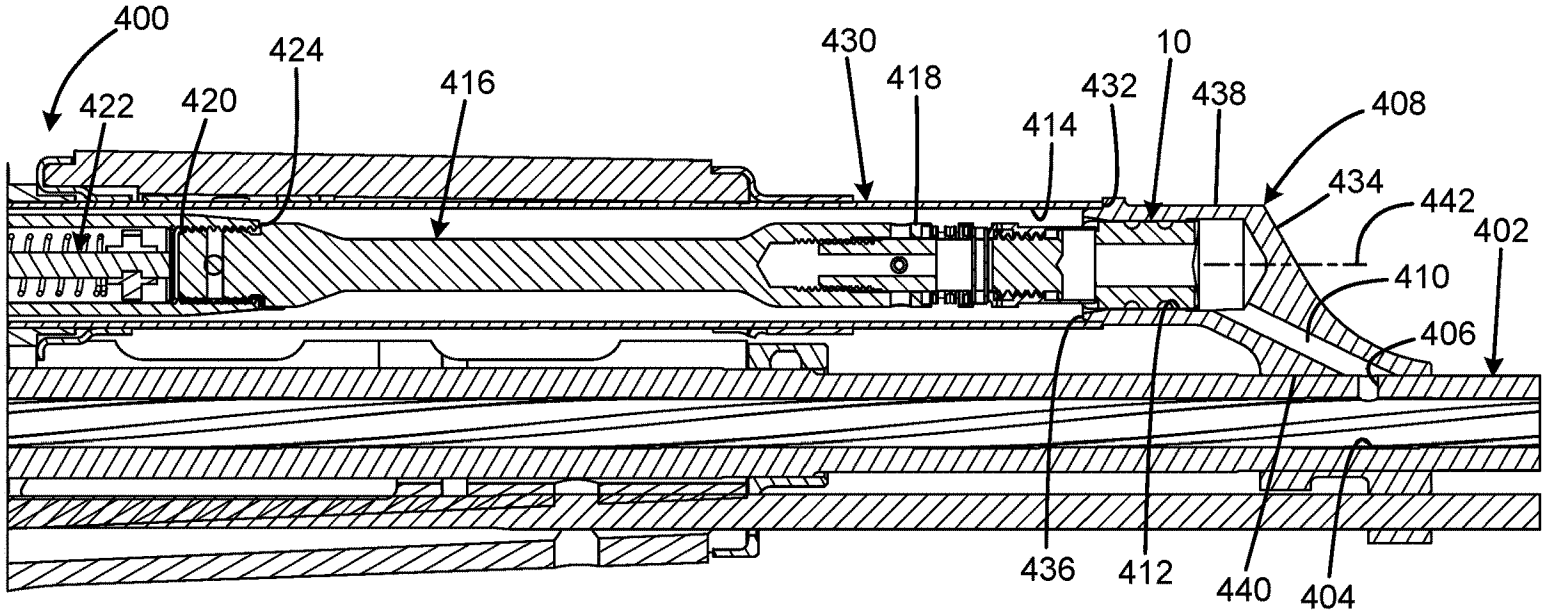
FIG. 1A is an enlargement of the rectangular area of FIG. 1.

FIGS. 1 and 1A illustrate the improved piston for a gas-operated firearm 10 of the present invention. More particularly, the piston for a gas-operated firearm is shown installed in a rifle 400. The rifle 400 has a barrel 402 that defines a central barrel bore 404. A gas port 406 is in fluid communication with the central barrel bore 404. A gas block 408 is attached to the barrel. The gas block has a gas passage 410 that enables fluid communication between the gas port and a rearward-facing cylindrical central bore 412 that defines a bore axis 442 and flares at the rear 436. A tube 430 has a central bore 414 that is in fluid communication with the central bore 412. The piston 10 is an elongated body having a front piston head portion 106 received within the central bore 412 of the gas block and the central bore 414 of the tube for reciprocation within the central bores. The periphery of the head portion is closely received in the central bore 412 of the gas block to provide a gas seal. The front 418 of a pushrod 416 is attached to the rear of the piston. The front 424 of a piston rod 422 is attached to the rear 420 of the pushrod. A rear protrusion 426 contacts an operating system/action 428 such that when high-pressure gas passes through the gas port 406, gas passage 410, and central bore 412, the high-pressure gas impinges upon the piston. Once sufficient gas pressure has accumulated within the central bore 412 to push the piston rearward, the rearward movement is communicated to the action via pushrod 416 and piston rod 422 such that the action is cycled. Thus, the pushrod and piston rod serve as an operational facility on the second, rearward side of the piston adapted to transmit an operating force to the action in response to gas pressure on the first, forward side of the piston.

Figure 2:
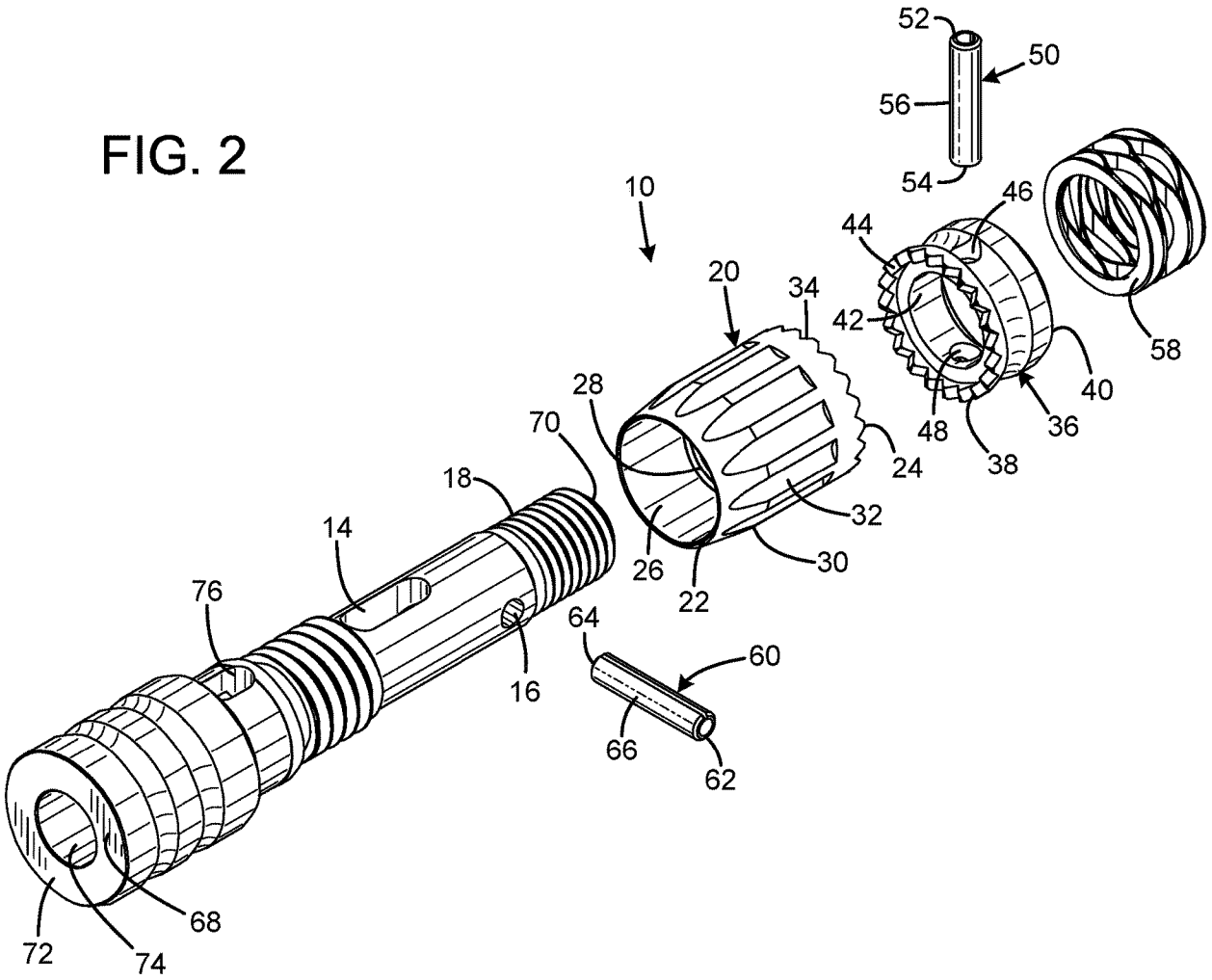
FIG. 2 is an exploded isometric view of the current embodiment of the piston for a gas-operated firearm of FIG. 1.
Figure 3:
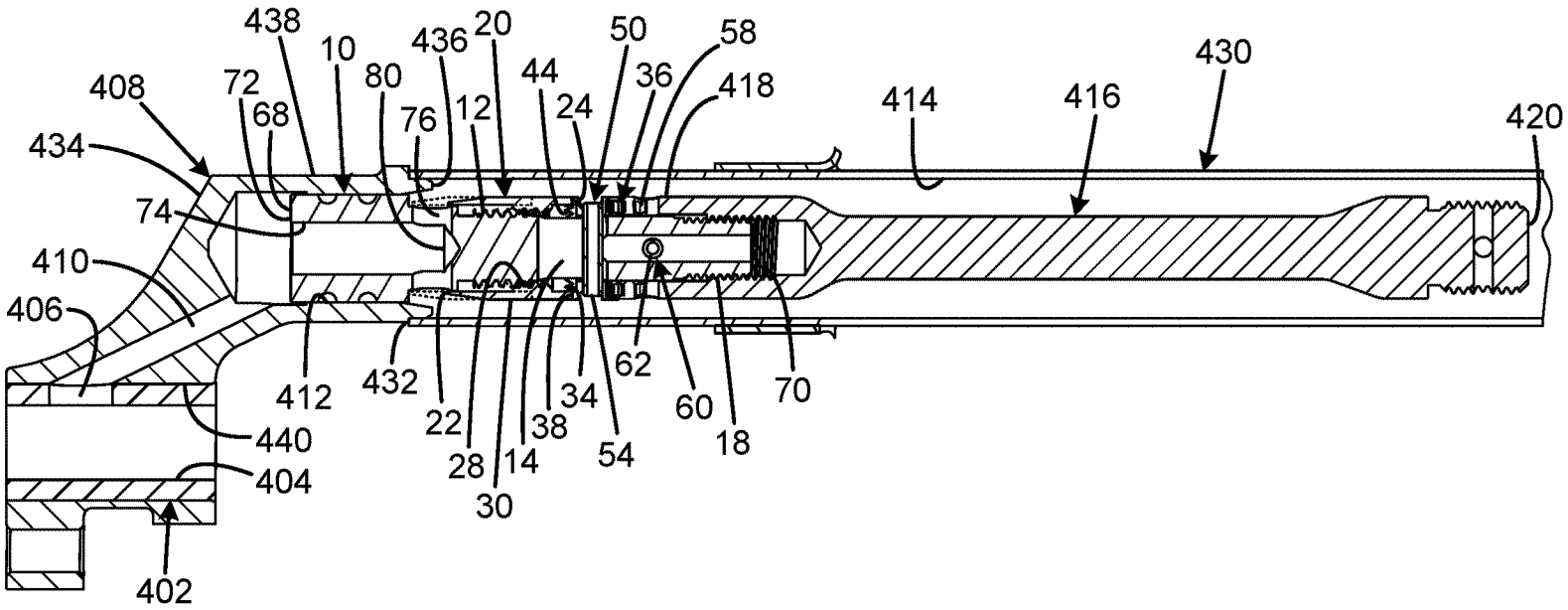
FIG. 3 is a side sectional view of the current embodiment of the piston for a gas-operated firearm of FIG. 1 installed in a gas block and tube.

FIGS. 2 and 3 illustrate the improved piston for a gas-operated firearm 10 of the present invention. More particularly, the piston for a gas-operated firearm is shown in FIG. 3 installed in the gas block 408 and tube 430 with a fragmentary view of the barrel 402. The gas block has a front 434, rear 436, top 438, and bottom 440. The bottom rear of the gas port defines the gas passage 410, and the bottom rear of the gas block is attached to the barrel 402 such that the gas passage is in fluid communication with the gas port 406. The rear of the gas block defines the central bore 412. The front 432 of the tube 430 is attached to the rear of the gas block such that the central bore 414 of the tube is in fluid communication with the central bore 412.

The piston 10 has a front 68 and a rear 70. The front serves as a piston head portion 72 and defines a central bore 74 having a rear 80. The rear portion of the central bore 74 has a smooth interior sidewall that defines two radial/lateral bypass passages 76 between the first, front side of the piston head and the second, rear side of the piston head. Thus, the central bore and bypass passages can also be viewed as a passage having a first portion extending from the first side through the head portion, and a second portion extending laterally from the first portion, with the passage having an inlet on the first side of the head portion and an outlet on the second side of the head portion. In addition, the outlet is rearward of a rear limit of the cylindrical central bore 412 of the gas block 408 defined by where the diameter of the central bore 412 flares at the rear 436. The two radial bypass passages are in fluid communication between the central bore 74 and the central bore 414 of the tube. The exterior of the piston has a threaded portion 12 located immediately behind the bypass passages. A longitudinal slot 14 is defined in the piston immediately behind the threaded portion 12. A lateral bore 16 is defined in the piston behind the longitudinal slot. The exterior of the piston has a threaded portion 18 at the rear.

An external collar 20 having a central bore 26 with a threaded portion 28 is threadedly connected to the threaded portion 12 of the piston 10 and receives a portion of the piston 10 within the central bore 26. The external collar has a front 22, rear 24, and an exterior 30. The exterior defines a plurality of flutes/recesses 32 to facilitate gripping and turning of the external collar. The rear of the external collar defines serrations 34.

A snap ring 36 having a central bore 42 is received by the rear 70 of the piston 10. The snap ring has a front 38 and rear 40. The front of the snap ring defines serrations 44 that are of a suitable size and shape to mesh with the serrations 34 on the rear 24 of the external collar 20. The snap ring defines two axially registered apertures 46, 48. A snap ring pin 50 has one end 52 received by aperture 46, and opposed end 54 received by aperture 48, and a middle portion 56 that is received by slot 14 in the piston 10. As a result, the snap ring is constrained to a limited amount of longitudinal travel relative to the piston 10 governed by the length of the slot 14, and rotation of the snap ring is prevented.

A spring 58 abuts the rear 40 of the snap ring 36 and fits over the rear 70 of the piston 10. A spring stop pin 60 has a middle portion 66 that is received within bore 16 in the piston 10. The spring stop pin has opposed ends 62, 64 that protrude outwardly from bore 16 such that the spring is compressed between the rear of the snap ring and the opposed ends of the spring stop pin and thereby is retained on the piston 10.

In FIG. 3, the solid lines show the external collar 20 in the fully open position that fully exposes the bypass passages 76. As a result, high-pressure gas passing through the gas port 406, gas passage 410, and accumulating within the central bore 412 not only impinges upon the piston head 72 and enters the central bore 74 of the piston 10 to impinge upon the rear 80 of the central bore 74, but a portion of the high-pressure gas can escape through the exposed bypass passages 76 into the central bore 414 of the tube 430, and subsequently vent to the external environment. Thus, the force of the gas pressure exerted upon the piston 10 and the action 428 is maximally reduced. The dashed lines in FIG. 3 denote the fully closed position of the external collar, in which the front 22 of the external collar completely covers the bypass passages. In this condition, no gas can escape from the central bore 74 of the piston 10, and the force of the gas pressure exerted upon the piston 10 and the action is maximized.

Because the external collar 20 is threadedly connected to the threaded portion 12 of the piston 10, the external collar can occupy a variety of positions determined by the pitch of the serrations 34, 44 between the fully closed and fully opened positions to enable partial exposure of the bypass passages 76 such that the force of the gas pressure exerted upon the piston 10 and the action 428 can be tuned to the desired amount to account for the presence or absence of a sound suppressor or specialized ammunition. The meshed engagement of the serrations 44 on the snap ring 36 with the serrations 34 on the external collar prevents the external collar from rotating once the external collar has been positioned to expose the desired portion of the bypass passages. The spring 58 ensures the serrations 34, 44 remain meshed together.

To change the portion of the bypass passages 76 that is exposed by the external collar 20, the user pulls the snap ring 36 rearward until the serrations 44 on the snap ring have disengaged from the serrations 34 on the external collar. While continuing to hold the snap ring rearward to compress the spring 58 and keep the serrations 34, 44 disengaged from each other, the user grips the exterior 30 of the external collar and rotates the external collar clockwise to decrease the exposure of the bypass passages or counterclockwise to increase the exposure of the bypass passages. Once the external collar is in the desired position, the user releases the snap ring. The compressed spring 58 urges the snap ring forward and re-engages the serrations 34, 44 with each other to prevent undesired rotation of the external collar. Thus, the external collar serves as an adjustment facility adapted to provide selectable resistance to gas flow through the bypass passages that is a movable occlusion element that selectably occludes the bypass passages. It should be appreciated that a nonadjustable version of this embodiment can be created by eliminating the external collar, snap ring, spring, and pins, and providing bypass passages of a suitable size in the piston 10 to achieve the desired force of the gas pressure exerted upon the piston and the action.

Figure 4:
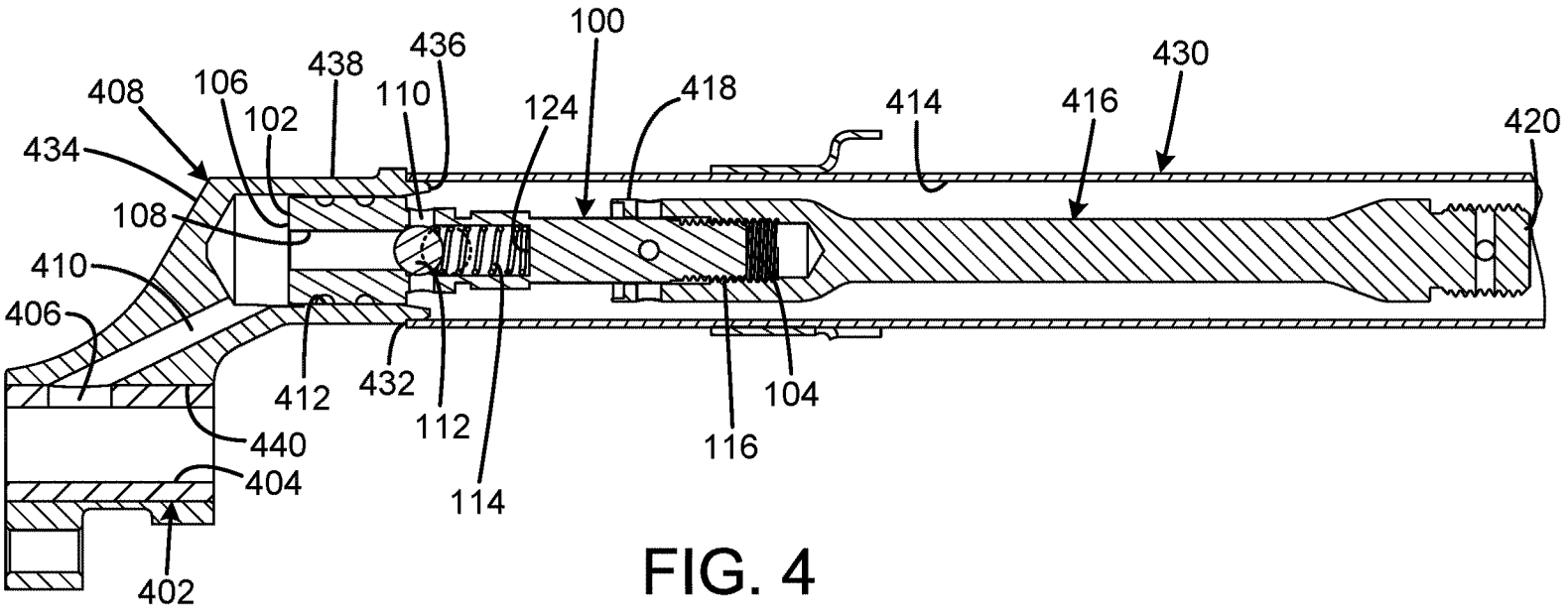
FIG. 4 is a side sectional view of a first alternative embodiment of the piston for a gas-operated firearm installed in a gas block and tube.

FIG. 4 illustrates a first alternative embodiment of the improved piston for a gas-operated firearm 100 of the present invention. More particularly, the piston 100 is shown installed in the gas block 408 and tube 430 with a fragmentary view of the barrel 402. The piston 100 has a front 102 and a rear 104. The front serves as a piston head 106 and defines a central bore 108 having a rear 124. The piston defines a radial/lateral bypass passage 110 that is in fluid communication between the central bore 108 and the central bore 414 of the tube. A ball 112 compresses a spring 114 against the rear of the 124 of the central bore 108. The ball and spring serve as a ball check valve for the bypass passage. The strength of the spring determines how much of the gas entering the central bore 108 can escape through the bypass passage 110 (denoted by the dashed lines in FIG. 4 showing the ball in a partially opened position). Thus, the force of the gas pressure exerted upon the piston 100 and the action 428 can be tuned to the desired amount to account for the presence or absence of a sound suppressor or specialized ammunition by using springs of different strengths. The rear of the piston 100 includes a threaded portion 116. A pushrod 416 having a front 418 and rear 420 has the front threadedly attached to the rear of the piston. It should be appreciated that a nonadjustable version of this embodiment can be created by eliminating the ball check valve and providing a bypass passage of a suitable size in the piston 100 to achieve the desired force of the gas pressure exerted upon the piston and the action.

Figure 5:
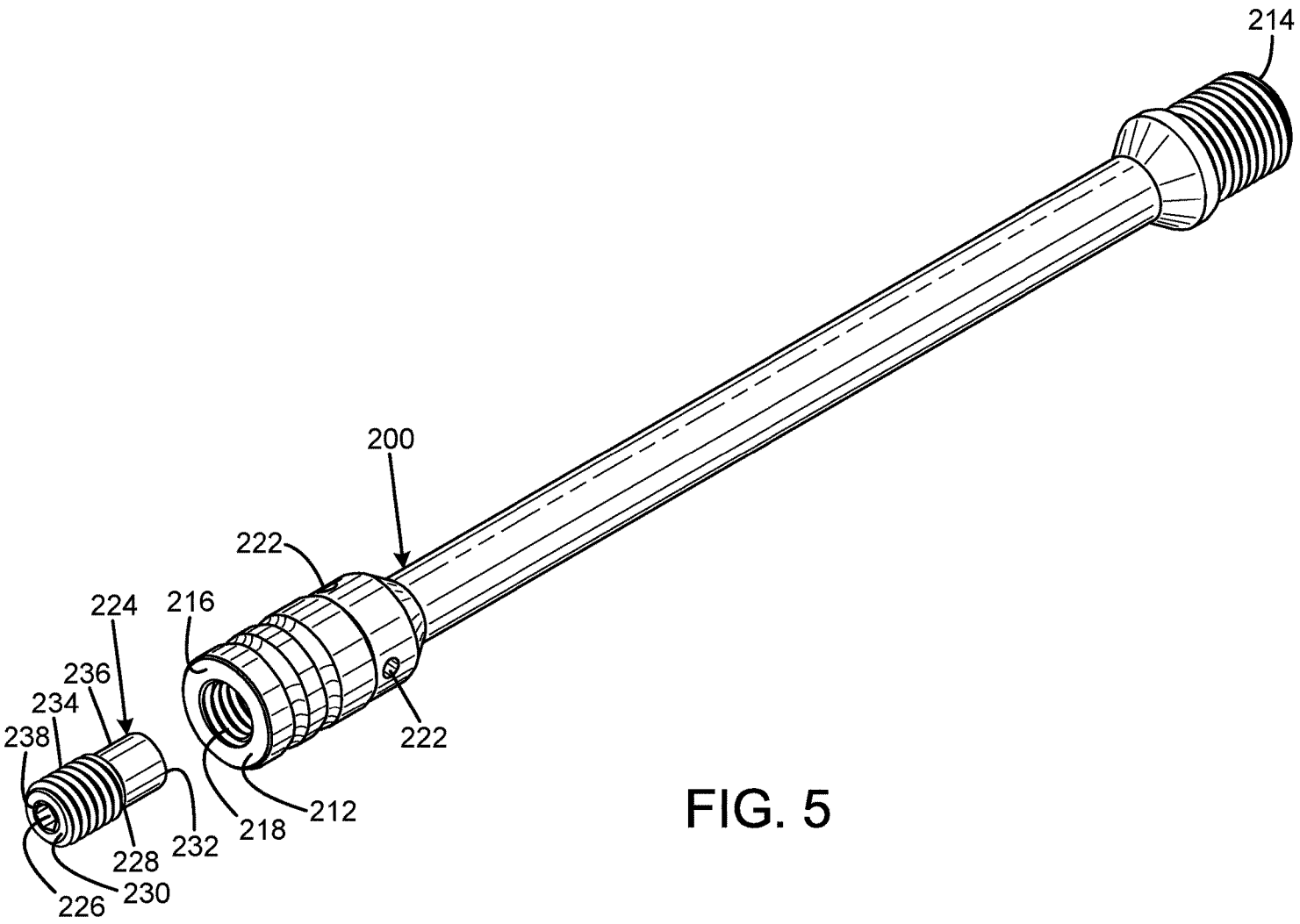
FIG. 5 is an isometric exploded view of a second alternative embodiment of the piston for a gas-operated firearm.
Figure 6:
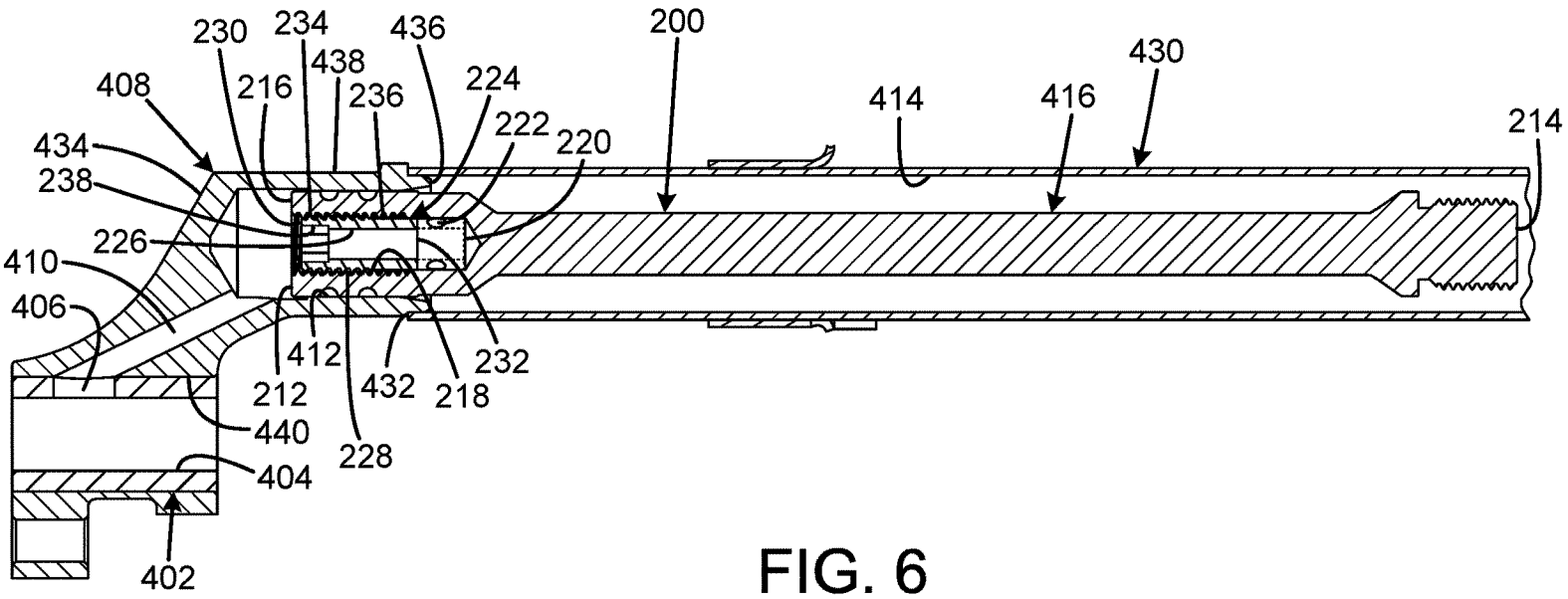
FIG. 6 is a side sectional view of the second alternative embodiment of the piston for a gas-operated firearm of FIG. 5 installed in a gas block and tube.

FIGS. 5 and 6 illustrate a second alternative embodiment of the improved piston for a gas-operated firearm 200 of the present invention. More particularly, the piston 200 is shown in FIG. 6 installed in the gas block 408 and tube 430 with a fragmentary view of the barrel 402. The piston 200 in the current embodiment is integral to the pushrod and has a forward-facing front 212 and rearward-facing rear 214. The front serves as a piston head portion 216 and defines a central bore 218 having a rear 220. The rear portion of the central bore 218 has a smooth interior sidewall that defines radial/lateral bypass passages 222 between the first, front side of the piston head and the second, rear side of the piston head. Thus, the central bore and bypass passages can also be viewed as a passage having a first portion extending from the first side through the head portion, and a second portion extending laterally from the first portion, with the passage having an inlet on the first side of the head portion and an outlet on the second side of the head portion. In addition, the outlet is rearward of a rear limit of the cylindrical central bore 412 of the gas block 408 defined by where the diameter of the central bore 412 flares at the rear 436. The remaining forward portion of the interior sidewall is threaded. The radial bypass passages are in fluid communication between the central bore 218 and the central bore 414 of the tube.

A threaded plunger 224 is a threaded tube threadedly received within the threaded central bore 218 of the piston head portion 216. The threaded plunger has a central bore 226, exterior 228, front 230, and rear 232. At least a forward portion of the central bore 226 defines a tool pocket 238 that extends through the front face of the piston head portion. The tool pocket is sized and shaped to receive a suitable tool to enable a user to apply torque to the threaded plunger to induce rotation. The exterior of the threaded plunger has a forward threaded portion 234 and a rearward smooth portion 236. In FIG. 3, the solid lines show the threaded plunger in the fully open position that fully exposes the bypass passages 222. As a result, high-pressure gas passing through the gas port 406, gas passage 410, and accumulating within the central bore 412 not only impinges upon the piston head 216 and enters the central bore 218 of the piston and the central bore 226 of the threaded plunger to impinge upon the rear 220 of the central bore 218, but a portion of the high-pressure gas can escape through the exposed bypass passages 222 into the central bore 414 of the tube 430 and subsequently vent to the external environment. Thus, the force of the gas pressure exerted upon the piston 200 and the action 428 is maximally reduced. The dashed lines in FIG. 6 denote the fully closed position of the threaded plunger, in which the smooth portion of the threaded plunger completely covers the bypass passages. In this condition, no gas can escape from the central bore 218 of the piston 200, and the force of the gas pressure exerted upon the piston 200 and the action is maximized.

Because the threaded plunger 224 is threadedly received within the central bore 218, the threaded plunger can occupy any position between the fully closed and fully opened positions to enable partial exposure of the bypass passages 222 such that the force of the gas pressure exerted upon the piston 200 and the action 428 can be tuned to the desired amount to account for the presence or absence of a sound suppressor or specialized ammunition. Thus, the threaded plunger serves as an adjustment facility adapted to provide selectable resistance to gas flow through the bypass passages that is a movable occlusion element that selectably occludes the bypass passages. It should be appreciated that a nonadjustable version of this embodiment can be created by eliminating the threaded plunger and providing bypass passages of a suitable size in the piston 200 to achieve the desired force of the gas pressure exerted upon the piston 200 and the action.

Figure 7:
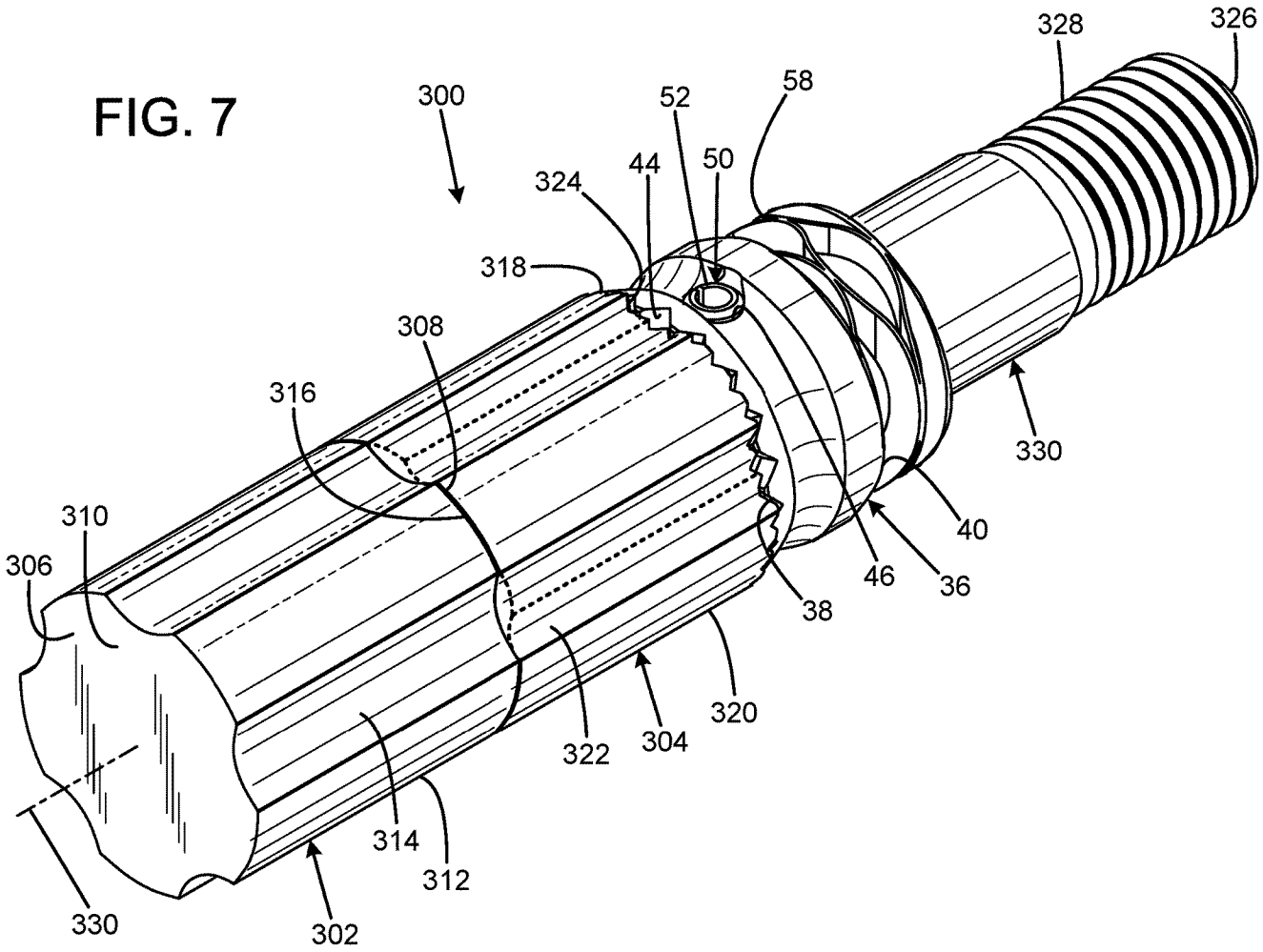
FIG. 7 is a front isometric view of a third alternative embodiment of the piston for a gas-operated firearm in the open position with dashed lines denoting a partially closed position.
Figure 8:
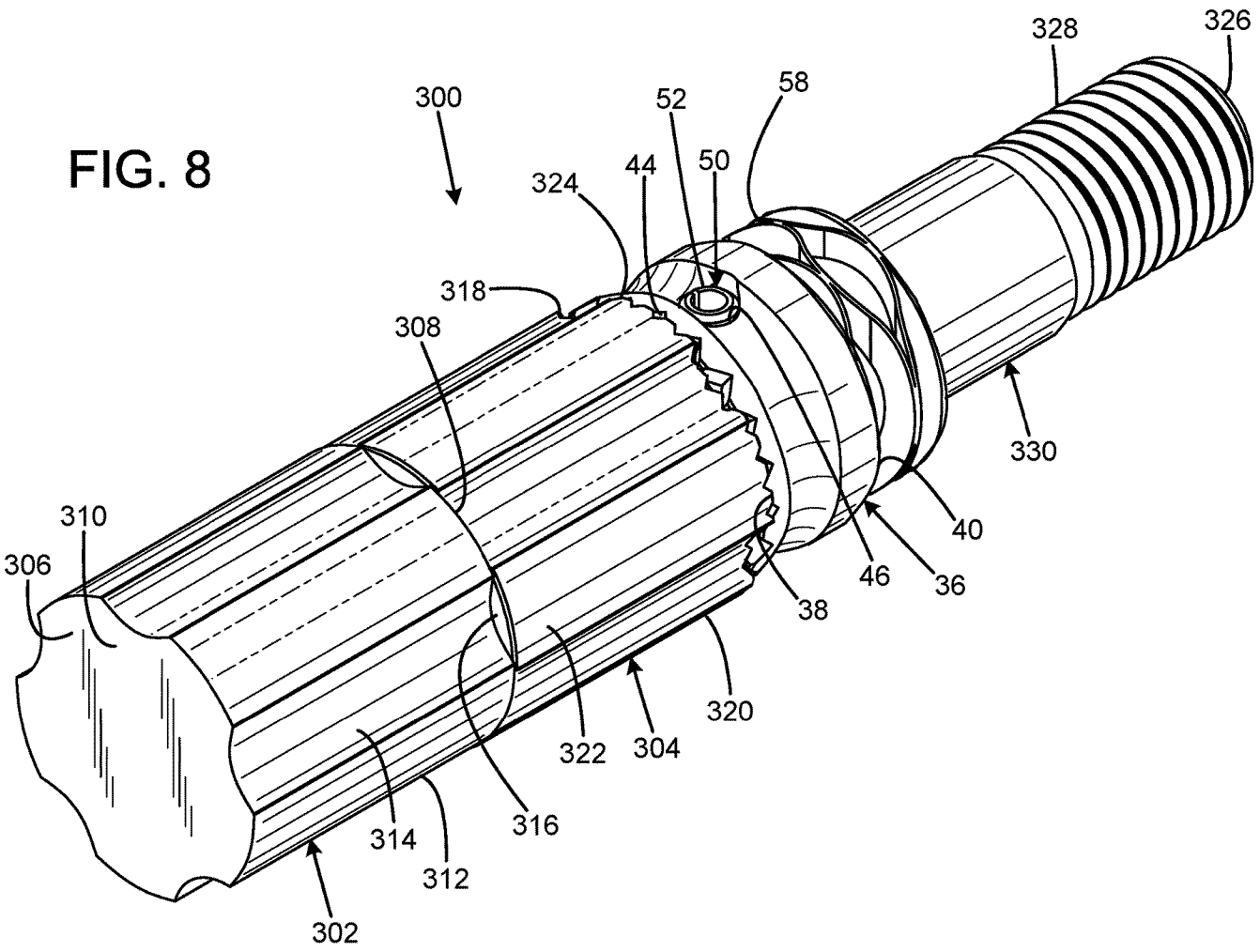
FIG. 8 is a front isometric view of the third alternative embodiment of the piston for a gas-operated firearm of FIG. 7 in the fully closed position.

FIGS. 7 and 8 illustrate a third alternative embodiment of the improved piston for a gas-operated firearm 300 of the present invention. More particularly, the piston has a front portion 302, a rear portion 304, and a shaft 330 extending rearwardly from the front portion. The rear portion is rotatably mounted on the shaft such that the front 316 of the rear portion closely abuts the rear 308 of the front portion. The front portion has a front 306 that serves as a piston head 310 and an exterior 312 having a plurality of flutes 314 that serve as bypass passages. The rear portion has an exterior 320 defining a plurality of flutes 322 that serve as bypass passages that are sized and spaced to enable axial registration of the flutes 322 with the flutes 314.

The rear of the rear portion defines serrations 324. A snap ring 36 having serrations 44 is mounted on the shaft 330 and secured by a snap ring pin 50 with limited longitudinal movement and no rotational movement in the manner described previously in the discussion of piston 10. Spring 58 is also mounted on the shaft and secured by a spring stop pin 60 in the manner described previously in the discussion of piston 10. The rear 326 of the shaft has a threaded portion 328 to connect to a pushrod 416.

In FIG. 7, the solid lines show the rear portion 304 in the fully open position that completely aligns the flutes 322 on the rear portion with the flutes 314 on the front portion. As a result, high-pressure gas passing through the gas port 406, gas passage 410, and accumulating within the central bore 412 not only impinges upon the piston head 310 and enters the flutes 314 of the front portion, but a portion of the high-pressure gas can enter flutes 322 on the rear portion and continue past the shaft 330 into the central bore 414 of the tube 430 and subsequently vent to the external environment. Thus, the force of the gas pressure exerted upon the piston 300 and the action 428 is maximally reduced.

The dashed lines in FIG. 7 illustrate a partially closed position where the flutes 322 on the rear portion 304 are only partially aligned with the flutes 314 of the front portion 302. As a result, some of the high-pressure gas entering the flutes 314 of the front portion impinges upon the front 316 of the rear portion prior to entering flutes 322 on the rear portion and continuing past the shaft 330 into the central bore 414 of the tube 430 and subsequently venting to the external environment. Thus, the force of the gas pressure exerted upon the piston 300 and the action 428 is partially reduced.

FIG. 8 shows the fully closed position of the piston 300 where the flutes 322 on the rear portion 340 are not aligned with the flutes 314 of the front portion 302. In this condition, all the high-pressure gas entering the flutes 314 of the front portion impinges upon the front 316 of the rear portion, and no gas can enter the flutes 322 in the rear portion and vent to the external environment because the exteriors of the front and rear portions are closely received in the central bore 412 of the gas block to provide a gas seal. As a result, the force of the gas pressure exerted upon the piston 300 and the action 428 is maximized. Because the rear portion is rotatably mounted on the shaft 330 of piston 300, the rear portion can occupy a variety of positions determined by the pitch of the serrations 44, 324 between the fully closed and fully opened positions to enable a variety of amounts of alignment of the flutes 322 of the rear portion with the flutes 314 of the front portion such that the force of the gas pressure exerted upon the piston 300 and the action can be tuned to the desired amount to account for the presence or absence of a sound suppressor or specialized ammunition. The meshed engagement of the serrations 44 on the snap ring 36 with the serrations 324 on the rear portion prevent the rear portion from rotating once the rear portion has been positioned to expose the desired portion of the front 316 of the rear portion. The spring 58 ensures the serrations 44, 324 remain meshed together.

To change the amount of alignment of the flutes 322 of the rear portion 304 with the flutes 314 of the front portion 302, the user pulls the snap ring 36 rearward until the serrations 44 on the snap ring have disengaged from the serrations 324 on the rear portion. While continuing to hold the snap ring rearward to compress the spring 58 and keep the serrations 44, 324 disengaged, the user grips the exterior 320 of the rear portion and rotates the rear portion in either direction to increase or decrease the amount of alignment of the flutes 322 of the rear portion with the flutes 314 of the front portion. Once the rear portion is in the desired position, the user releases the snap ring. The compressed spring 58 urges the snap ring forward and re-engages the serrations 44, 324 to prevent undesired rotation of the rear portion. Thus, the rear portion serves as an adjustment facility adapted to provide selectable resistance to gas flow through the flutes/bypass passages that is a movable occlusion element that selectably occludes the flutes/bypass passages. Furthermore, the occlusion element is an end portion of the body rotatable about a major axis of the body with respect to a rear portion of the body. It should be appreciated that a nonadjustable version of this embodiment can be created by combining the front and rear portions into a fixed element and having them define flutes of a suitable size and shape to achieve the desired force of the gas pressure exerted upon the piston and the action.

While current embodiments of a piston for a gas-operated firearm have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any quantity or size of bypass passage could be substituted for the bypass passage quantities described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A piston for a gas operated firearm having a gas block defining a cylindrical bore having a bore axis in communication with a barrel bore and an open end of the cylindrical bore facing a rearward direction toward an operating system, the piston comprising:

an elongated body having a head portion adapted to be closely received in the cylindrical bore for reciprocation within the bore;

the head portion having a first side toward a forward direction and a second side toward the rearward direction;

the body having an operational facility on the second side adapted to transmit an operating force to the action in response to gas pressure on the first side;

the head portion defining a bypass passage between the first side and the second side; and wherein the bypass passage has an adjustment facility adapted to provide selectable resistance to gas flow through the bypass passage.

2. The piston of claim 1 wherein the adjustment facility is a movable occlusion element that selectably occludes the bypass passage.

3. The piston of claim 2 wherein the occlusion element is a threaded element.

4. The piston of claim 2 wherein the occlusion element is a collar that receives a portion of the body.

5. The piston of claim 2 wherein the occlusion element is a threaded tube received in a threaded bore in the body.

6. The piston of claim 2 wherein the occlusion element is a middle portion of the body rotatable about a major axis of the body with respect to a front portion of the body.

7. The piston of claim 6 wherein the occlusion element includes elongated channels along the length of the middle portion.

8. The piston of claim 1 wherein the head portion has a front face, and wherein the passage extends through the front face.

9. The piston of claim 8 wherein the passage exits a lateral port at the second side.

10. The piston of claim 1 wherein the passage has a first portion extending from the first side through the head, and a second portion extending laterally from the first portion.

11. A piston for a gas operated firearm having a gas block defining a cylindrical bore having a bore axis in communication with a barrel bore and an open end of the cylindrical bore facing a rearward direction toward an operating system, the piston comprising:

an elongated body having a head portion adapted to be closely received in the cylindrical bore for reciprocation within the bore;

the head portion having a first side toward a forward direction and a second side toward the rearward direction;

the body having an operational facility on the second side adapted to transmit an operating force to the action in response to gas pressure on the first side;

the head portion defining a bypass passage between the first side and the second side;

wherein the passage has an inlet on the first side and an outlet on the second side, and wherein the outlet is rearward of a rear limit of the cylindrical bore.

12. The piston of claim 1 wherein the periphery of the head portion is closely received in the cylindrical bore to provide a gas seal.

13. A piston for a gas operated firearm having a gas block defining a cylindrical bore having a bore axis in communication with a barrel bore and an open end of the cylindrical bore facing a rearward direction toward an operating system, the piston comprising:

an elongated body having a head portion adapted to be closely received in the cylindrical bore for reciprocation within the bore;

the head portion having a first side toward a forward direction and a second side toward the rearward direction;

the body having an operational facility on the second side adapted to transmit an operating force to the action in response to gas pressure on the first side; and the head portion defining a bypass passage between the first side and the second side, the bypass passage remaining open during all operation conditions of the firearm.

14. The piston of claim 13 wherein the bypass passage has an adjustment facility adapted to provide selectable resistance to gas flow through the bypass passage.

15. The piston of claim 13 wherein the head portion has a front face, and wherein the passage extends through the front face.

16. The piston of claim 13 wherein the passage has a first portion extending from the first side through the head, and a second portion extending laterally from the first portion.

17. The piston of claim 13 wherein the periphery of the head portion is closely received in the cylindrical bore to provide a gas seal.

* * * * *